US006946613B2

(12) United States Patent
Otsuka et al.

(10) Patent No.: US 6,946,613 B2
(45) Date of Patent: Sep. 20, 2005

(54) GAS-INSULATED SWITCHGEAR

(75) Inventors: Takuya Otsuka, Tokyo (JP); Hitoshi Sadakuni, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/642,653

(22) Filed: Aug. 19, 2003

(65) Prior Publication Data

US 2004/0042158 A1 Mar. 4, 2004

(30) Foreign Application Priority Data

Aug. 29, 2002 (JP) ..... 2002-250603

(51) Int. Cl.[7] ..... H01H 33/70
(52) U.S. Cl. ..... 218/79; 218/7; 218/78
(58) Field of Search ..... 218/2–7, 14, 43–45, 218/70, 78–80, 84, 120, 140, 153, 154, 13, 155

(56) References Cited

U.S. PATENT DOCUMENTS 4,223,191 A * 9/1980 Calvino ..... 218/4
4,468,716 A * 8/1984 Kamata et al. ..... 218/4
6,538,224 B2 * 3/2003 Furuta et al. ..... 218/43
6,680,453 B2 * 1/2004 Rokunohe et al. ..... 218/2
6,683,267 B1 * 1/2004 Piazza et al. ..... 218/2

FOREIGN PATENT DOCUMENTS

JP 59-179416 11/1984
JP 09-129096 A 5/1997
JP 10-334773 12/1998
JP 2002-051416 A 2/2002

* cited by examiner

*Primary Examiner*—Lincoln Donovan
*Assistant Examiner*—M. Fishman
(74) *Attorney, Agent, or Firm*—Sughrue Mion, PLLC

(57) ABSTRACT

A gas-insulated switchgear includes a tank filled with an electrically insulating gas, first and second conductors disposed within the tank, a disconnector for disconnecting the first conductor and the second conductor from each other, and a grounding switch for grounding the first conductor when the disconnector is in an open position. The disconnector includes a first and second fixed electrode disposed on the first and second conductors, respectively, a bridging movable electrode that is always maintained in contact with the first electrode and that is slidably movable for contacting with and separating from the second fixed electrode to connect and disconnect the first and second fixed electrodes, and an operating mechanism for opening and closing operation of the movable electrode. The grounding switch includes the bridging movable electrode which is in contact with the first contact, and a third fixed grounding electrode disposed to the tank capable of contacting with the movable electrode when the movable electrode is separated from the second electrode. The operating mechanism is provided with an electrically insulating operating rod extending through the first fixed electrode in the direction of movement of the movable electrode.

10 Claims, 6 Drawing Sheets

GAS-INSULATED SWITCHGEAR

BACKGROUND OF THE INVENTION

This invention relates to a gas-insulated switchgear, in particular to a gas-insulated switchgear including a disconnecting switch and a grounding switch.

FIGS. 7 and 8 are schematic sectional views showing the internal structure of a gas-insulated switchgear 100 of the conventional type that is structurally almost same as the one including a disconnecting switch that is bent at a right angle in the middle as shown in FIG. 1 of Japanese Patent Laid-Open Hei 3-5014 and is equipped with a grounding switch as shown in FIG. 3 of Japanese Published Unexamined Patent Application Sho 60-5711.

The gas-insulated switchgear shown in FIGS. 7 and 8 includes a tank 101 filled with an electrically insulating gas, a first and second conductors 102 and 103 disposed within the tank 101 and disposed at right angles to each other, a disconnecting switch or a disconnector 104 for disconnecting the conductor 102 from the conductor 103 and a grounding switch 105 for grounding the first conductor 102 when the disconnector 104 is opened as illustrated in the figures.

The disconnector 104 is provided with a first fixed contact 107 connected through a connecting section 106 to the tip of the first conductor 102, a second fixed contact 109 connected through a connecting section 108 to the tip of the second conductor 103, a movable contact 110 disposed in the way in which it can move forward to reach to the second fixed contact 109 and bridge the gap between the first fixed contact 107 and the second fixed contact 109 and backward to withdraw from the second fixed contact 109, while always touching the inner surface of the first fixed contact 107, thus putting the first fixed contact 107 in or out of contact with the second fixed contact 109 and a first operating mechanism 111 that is disposed on the outer surface of the wall of the tank 101, extends as far as the inside of the connecting section 106 to be connected to the movable contact 110 and drives the movable contact 110. Both the connecting sections 106 and 108 are held on the tank 101 by an insulation support 112.

The grounding switch 105 is provided with a third fixed contact 113 connected through a connecting section 106 to the first conductor 102 like the first fixed contact 107 described above, a fourth fixed contact 114 disposed on the outer surface of the wall of the tank 101, a second movable contact 115 disposed in the way in which it can move forward to reach to the third fixed contact 113 and bridge the gap between the third fixed contact 113 and the fourth fixed contact 114 and backward to withdraw from the third fixed contact 113, while always touching the inner surface of the fourth fixed contact 114, thus putting the fourth fixed contact 114 in or out of contact with the third fixed contact 113 and a second operating mechanism 116 that is disposed on the outer surface of the wall of the tank 101 and is connected to the second movable contact 115 for driving the movable contact 115. The tank 101 is provided with insulated supports 121 for the connecting sections 106 and 108, as well as a plurality of manholes 117 for maintenance and inspection.

In disconnectors for gas-insulated switchgears of the conventional type, the electrodes at both the movable and fixed sides are held within the tank by insulation supports and the grounding switch is fastened to the tank in the way in which a movable contact can move to be connected to the electrodes. Gas-insulated switchgears including such disconnectors and grounding switches often suffer from a poor work efficiency in performing the setting-up of the parts that is made primarily on the tank as a consequence of a narrow space within the tank, and it is necessary to provide such switchgears with a peep hole for adjusting and checking the connection between electrodes. Further, conventional switchgears need to be provided with such parts as a shaft seal, fastening flanges and operation devices for connecting the disconnector and the grounding switch separately to their respective operating mechanisms disposed outside the tank, thus making it difficult to omit such parts.

SUMMARY OF THE INVENTION

The present invention, that has been made to solve the problems described above, has as its object the provision of a gas-insulated switchgear in which structures for connecting to and supporting within the tank of switching devices including disconnector and grounding switch is simplified, and these devices are supported only by a single flange and mounted on the tank at a single position using the flange after being assembled outside the tank and introduced altogether into the tank as an assembly.

The gas-insulated switchgear according to the invention includes a tank filled with an electrically insulating gas, first and second conductors disposed within said tank, a disconnector for disconnecting said first conductor and said second conductor from each other, and a grounding switch for grounding said first conductor when said disconnector is in an open position. The disconnector includes a first and second fixed electrode disposed on said first and second conductors, respectively, a bridging movable electrode that is always maintained in contact with said first electrode and that is slidably movable for contacting with and separating from said second fixed electrode to connect and disconnect said first and second fixed electrodes, and an operating mechanism for opening and closing operation of said movable electrode. The grounding switch includes said bridging movable electrode which is in contact with said first contact, and a third fixed grounding electrode disposed to said tank capable of contacting with said movable electrode when said movable electrode is separated from said second electrode. The operating mechanism is provided with an electrically insulating operating rod extending through said first fixed electrode in the direction of movement of said movable electrode.

The gas-insulated switchgear of the present invention includes a tank filled with an electrically insulating gas, first and second conductors disposed within said tank, and a disconnector disconnecting said first conductor and said second conductor from each other. The disconnector includes a first and second fixed electrode disposed on said first and second conductors, respectively, a bridging movable electrode for connecting and disconnecting said first and second fixed electrodes from each other, and an operating mechanism for opening and closing operation of said movable electrode. The movable electrode is always in contact with said first fixed electrode and capable of contacting with and separating from said second fixed electrode. The operating mechanism is provided with an electrically insulating operating rod extending through said first fixed electrode in the direction of movement of said movable electrode.

BRIEF DESCRIPTION OF THE DRAWINGS

The present invention will become more readily apparent from the following detailed description of the preferred embodiments of the present invention taken in conjunction with the accompanying drawings, in which.

DETAILED DESCRIPTION OF THE PREFERRED EMBODIMENTS

Embodiment 1.

Figure 1:
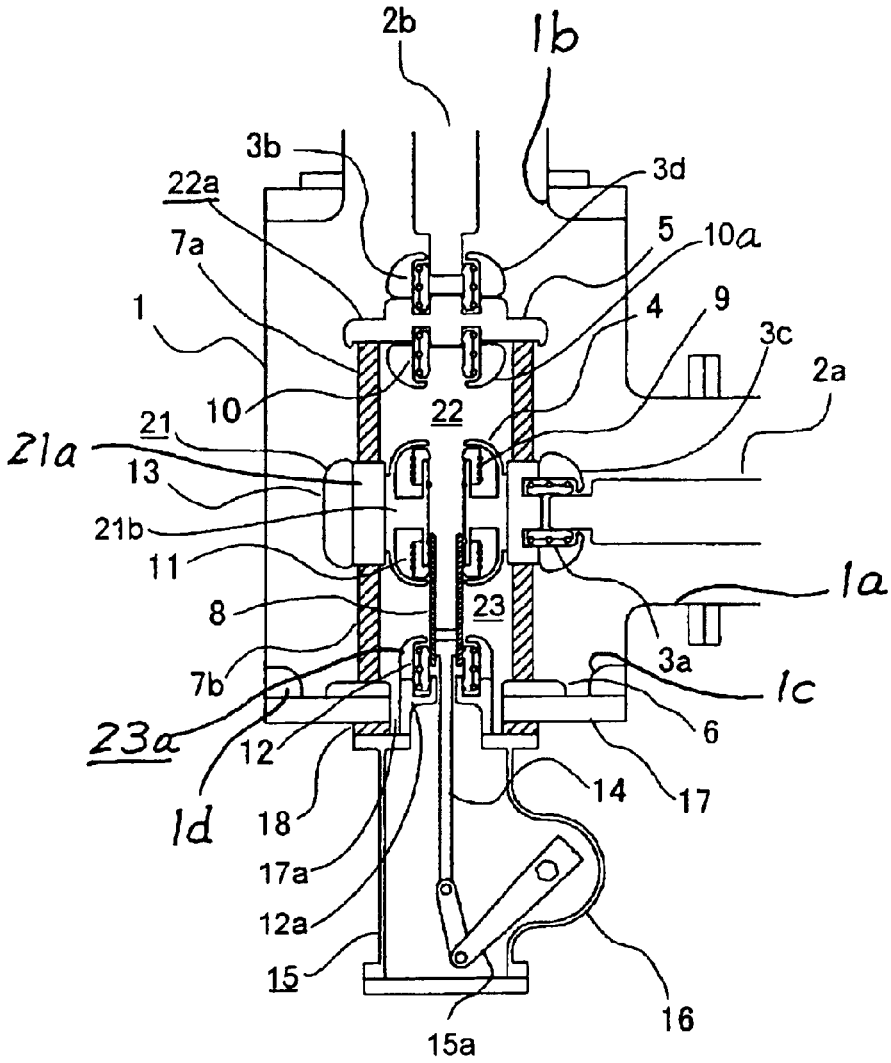
FIG. 1 is a schematic cross-sectional elevation showing the structure of a gas-insulated switchgear including a disconnector and a grounding switch embodying the present invention.

FIG. 1 shows the structures of a disconnector and a grounding switch embodying the present invention being included in a gas-insulated switchgear. The gas-insulated switchgear includes a tank 1 filled with an electrically insulating gas, a first conductor 2*a* and a second conductor 2*b*, both being disposed within the tank 1, a disconnector 22 for disconnecting the first conductor 2*a* from the second conductor 2*b*, and a grounding switch 23 for grounding the first conductor 2*a* when the disconnector 22 is open. The first and second conductors 2*a* and 2*b* are disposed at right angles to each other to form a branched structure in which two branches are at right angles to each other. The tank 1 is an approximately T-shaped grounding vessel combining two cylindrical parts joined at right angles to each other, and the three ends 1*a*, 1*b* and 1*c* of the T-shaped structure are open. The first conductor 2*a* is introduced into the tank 1 through the open end 1*a* and the second conductor 2*a* is introduced into the tank 1*a* through the open end 1*b*.

The third open end 1 c of the T-shaped tank 1 being provided at the edge thereof with an approximately circular fitting flange section 1*d* where substantially whole area of the open end of the cylindrical part of the tank 1 is uncovered. The open end 1*c* can be closed airtight when a disc-shaped flange 17 is fitted to the fitting flange section 1*d* with bolts or other suitable means. Insulating supports 7*a* and 7*b* in the form of a hollow cylinder are mounted on the inner surface of the flange 17 through an adapter 6. A first electrode 21 is held between the insulation supports 7*a* and 7*b*. A second electrode 22*a* is supported by the insulation support 7*a* at the end opposite to the end holding the first electrode 21. The insulation supports 7*a* and 7*b* may be formed into either a single member or separate members. An operating mechanism 15 is held on the outer surface of the flange 17 together with a third electrode 23*a* through an insulation support 18. The third electrode 23*a* is grounded together with the operating mechanism 15. Thus, the first, second and third electrodes 21, 22*a* and 23*a* as well as the operating mechanism 15 are supported only by the flange 17 without being connected to the tank 1 or any other members. The electrodes 21, 22*a* and 23*a* being separated from each other are insulated individually and are aligned along the axis of the second conductor 2*b*. The sections of the disconnector, the grounding switch and other members to be assembled on the flange 17 and accommodated in the tank 1 are rendered to be in a size smaller than that of the open end 1*c* of the tank 1 so that these members can be introduced altogether into the tank 1 as an assembly set up on the flange 17.

The first electrode 21 includes an electrode base 21*b* that is substantially hollow and circular and has a circular flange. The electrode base 21*b* is fitted to a connecting conductor 21*a* that is supported by the insulation supports 7*a* and 7*b*. The upper end of the cylindrical section of the electrode base 21*b* is provided with a contact 9 composed of a group of finger-shaped contact pieces biased inwardly by the ring spring, while the lower end of the cylindrical section is provided with a contact 11 composed of a similar group of such contact pieces. Both of the contacts 9 and 11 are covered by a shield conductor 4 for electric field relaxation that extends from the flange of the electric base 21*b* toward the center of the electrode 21 and is curved gently to give the first electrode 21 a cylindrical form as a whole with rounded upper and lower ends. The connecting conductor 21*a* of the first electrode 21 is connected to the tip of the first conductor 2*a* through a contact 3*a* composed of a ring spring and a group of finger-shaped contact pieces. A shield 3*c* for electric field relaxation is disposed around the contact 3*a* and a shield 13 for electric field relaxation is disposed around the section of the connecting conductor 21*a* opposite to the side connected to the first conductor 2*a*.

The second electrode 22*a* includes an approximately disc-shaped connecting conductor 5 supported by the insulation support 7*a*, a contact 10 mounted on the inner surface of the connecting conductor 5, a shield 10*a* shielding the contact 10, a contact 3*b* mounted on the outer surface of the connecting conductor 5, and a shield 3*d* shielding the contact 3*b*. The contacts 10 and 3*b* are contacts composed of a ring spring and a group of finger-shaped contact pieces, similar to the contacts 9 and 11. The second conductor 2*b* is connected at the tip thereof to the contact 3*b* disposed outside the second electrode 22*a*.

The third electrode 23*a* includes a hollow connecting conductor 12*a* that extends from the outer surface of the flange 17 passing through an opening 17*a* formed in the middle of the flange 17 as far as the inside of the tank 1, a contact 12 mounted on the connecting conductor 12*a* and composed of a ring spring and a group of finger-shaped contact pieces, like the contacts 9 and 11, and a shield 12*b* shielding the contact 12. The third electrode 23*a* is grounded.

The operating mechanism 15 described above is connected to the third electrode 23*a*, disposed outside the tank 1, and fitted to the tank 1 by the flange 17 though the insulation support 18. The operating mechanism 15 comprises a casing 16 supported by the insulation support 18, a link mechanism 15*a* disposed within the casing 16 and driven to cause or break linking by an unillustrated outside driving unit, and an operation rod 14 one end thereof being connected to the link mechanism 15*a* and the other end thereof extending across the connecting conductor 12*a* and the contact 12 of the third electrode 23*a*. The operation rod 14 is connected at the end extending across the third electrode 23*a* thereof to a movable contact 8 in the shape of a rod that moves in the line of axis so that it causes or breaks an electric linking between the second and third electrodes. The axes of the second conductor 2*b*, the second electrode 22*a*, the first electrode 21, the third electrode 23*a*, the movable contact 8 and the operation rod 14 are aligned.

In a gas-insulated switchgear according to the present invention, the grounding switch 23 includes the second fixed contact 11 of the first electrode 21, the fixed contact 12 of the third electrode 23*a* which is mounted on the tank 1 and through which the operating rod 14 extends therethrough, and the bridging movable contact 8 slidably connecting between the first and the third electrodes 21 and 23*a* when the movable contact 8 is in a position bridging these electrodes 21 and 23*a*. The operating mechanism 15 is provided with the operating rod 14 that is permitted to extend through the second fixed contact 11 of the first electrode 21 in the line of the direction of the movement of the movable contact 8.

Figure 2A:
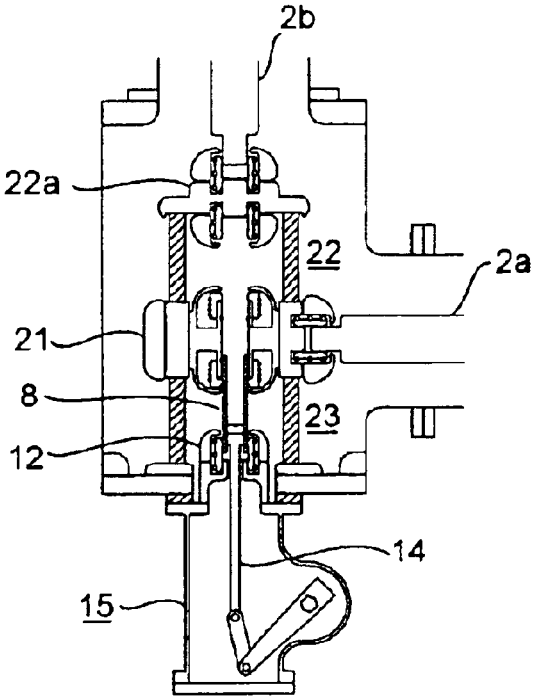
FIG. 2 is an illustration showing the changes in the position of movable members of the gas-insulated switchgear of FIG. 1.
Figure 2B:
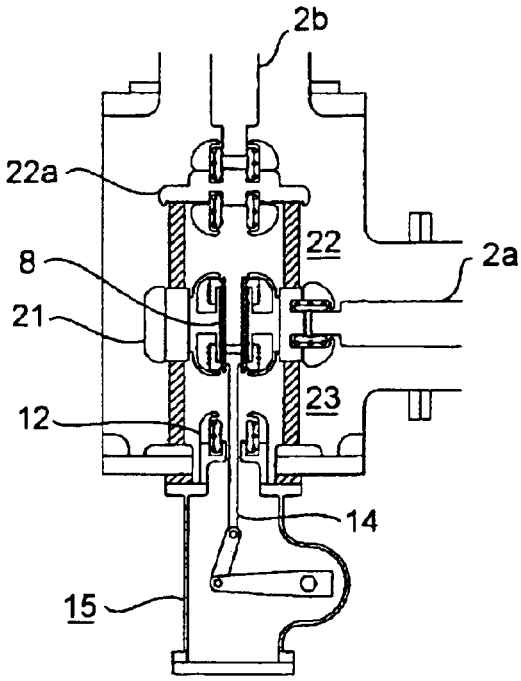
Figure 2C:
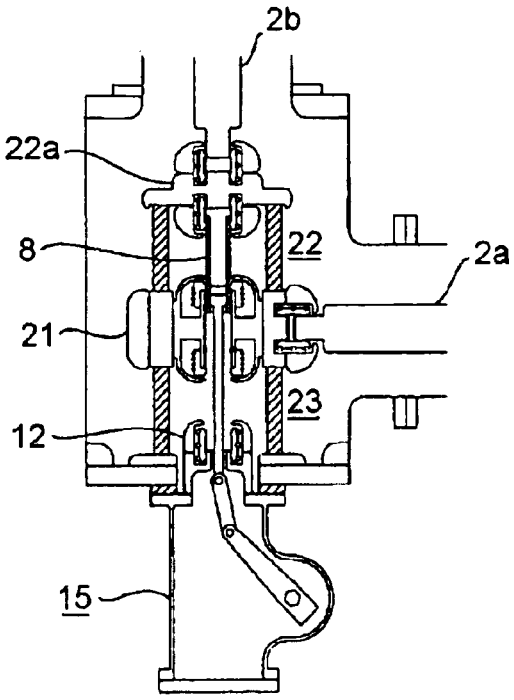

FIGS. 2*a*, 2*b* and 2*c* show the switching sequence of the disconnector 22 and the grounding switch 23 of the gas-insulated switchgear of FIG. 1. FIG. 2*a* illustrates the disconnector 23 in opening and the grounding switch 23 in closing wherein the movable contact 8 is bridging the gap between the fixed contacts 11 and 12. The status of the disconnector 22 and the grounding switch 23 shifts from that in FIG. 2*a* to FIG. 2*b* when the movable contact 8 being driven by an outside driving unit through a link 15*a* of the operating mechanism 15 and the insulation operation rod 14 moves forward to be contained within the shield 4 of the first electrode 21, causing the opening of both the disconnector 22 or the grounding switch 23. When the movable contact 8 moves further to the position in which it bridges the gap between the contacts 9 and 10 as shown in FIG. 2*c*, the disconnector 22 is closed. Thus, through the shift in the position of the movable contact 8 among the three points, it is possible to govern the switching action of the disconnector 22 and the grounding switch 23. A gas-insulated switchgear of this structure is highly advantageous in achieving cost savings because the switchgear wherein the first electrode 21 posessing fixed contacts 9 and 11 is shared by the disconnector 22 and the grounding switch 23 needs a smaller number of movable contacts, insulation rods, outside operating mechanism and other parts, a smaller space due to a reduction in the number of parts to be accommodated, and a lesser shaft sealing.

Figure 3:
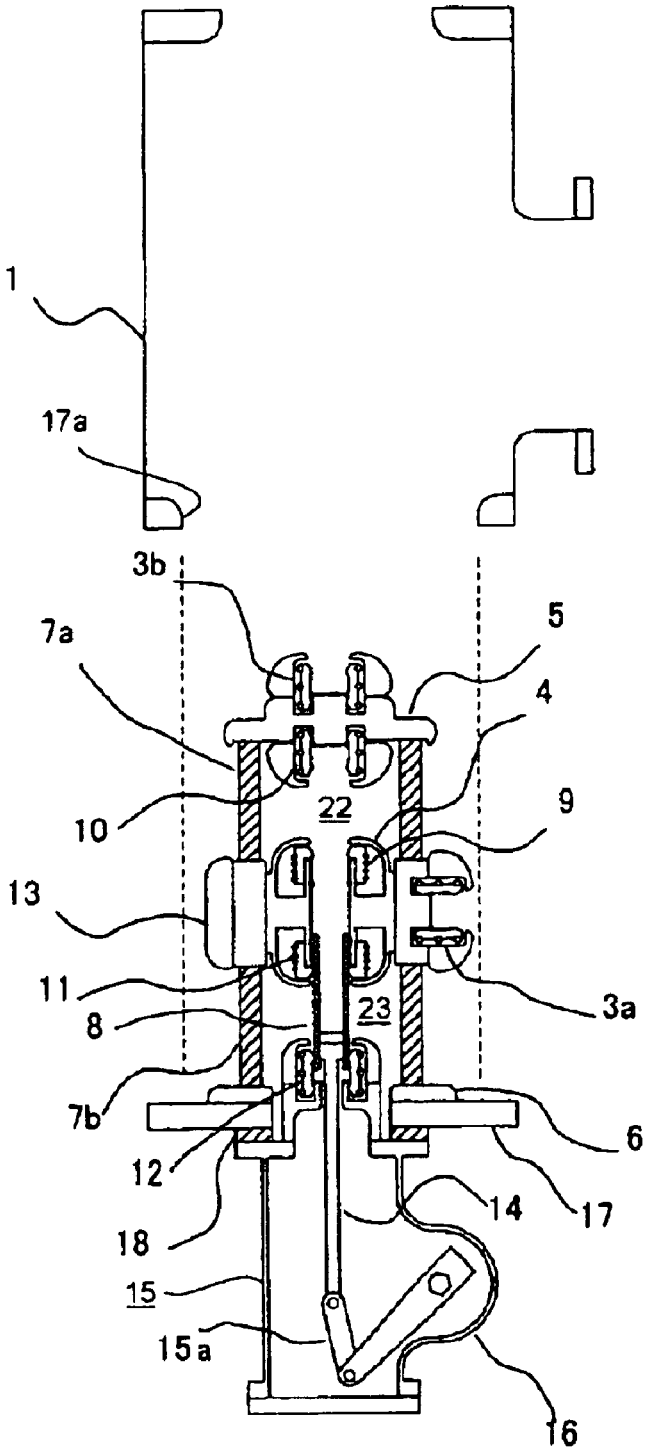
FIG. 3 is an illustration showing an assembly of devices to be accommodated within the gas-insulated switchgear of FIG. 1.

FIG. 3 illustrates an arrangement of the disconnector 22 and the grounding switch 23 in the gas-insulated switchgear shown in FIG. 1. As shown in FIGS. 1, 2*a* or 2*c*, the flange 17 for holding the disconnector 22 and the grounding switch 23, shaft seals and other members are concentrated on the adapter 6 disposed on the flange 17 to finish, outside the tank 1, the preparation of a core assembly and the adjustment of the centers among electrodes. It is essential that the core assembly is rendered to be in a size smaller than that of the open end 1*c* of the tank 1 so that the devices to be accommodated can be introduced altogether into the tank 1. The adapter 6 is fitted to the flange 17 of the tank 1 to finish the setting-up of the disconnector 22 and the grounding switch 23 in the tank 1. This procedure of setting-up eliminates the need for forming a manhole for maintenance and inspection in the tank because it is not necessary to perform within the tank inter-electrode adjustment or connection of insulation rods.

Being structured like this, a gas-insulated switchgear embodying the present invention has such advantageous as 1) a smaller number of parts as a result of the sharing of parts by the disconnector and the grounding switch, 2) improved work efficiency due to the completion of a core assembly outside the tank as a consequence of gathering together on one side of holding members and shaft leading sections and 3) a lower tank manufacturing cost due to a smaller need for disposing flanges to sections onto which devices are fastened, or those for shaft sealing and manholes for maintenance/inspection.

Embodiment 2

Figure 4:
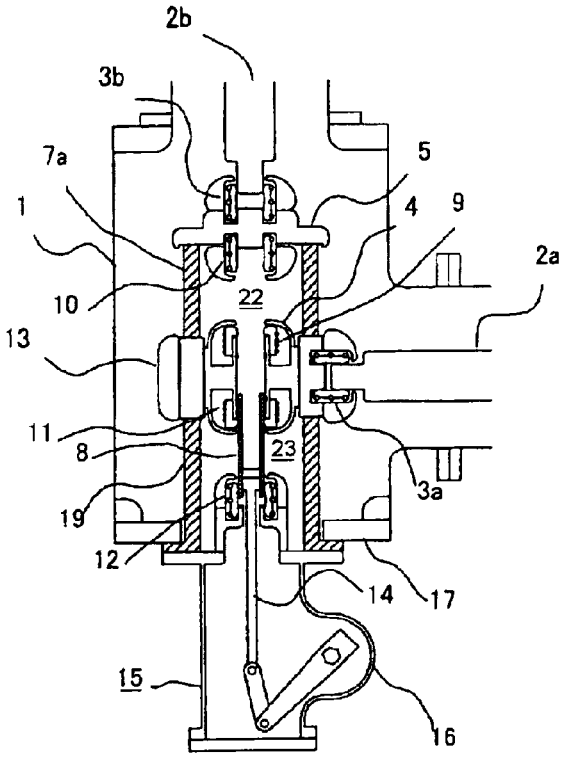
FIG. 4 is a schematic cross-sectional elevation of another gas-insulated switchgear embodying the present invention.

FIG. 4 illustrates the structure of the disconnector 22 and the grounding switch 23 in a gas-insulated switchgear shown as another embodiment of the present invention. While the gas-insulated switchgear shown as embodiment 1 in FIG. 1 has the insulation support 7*b* for insulation among the electrodes and the insulation adapter 18 as separate parts fastened individually to the flange 17, the gas-insulated switchfear in this embodiment has an insulation support 19 (the member equivalent to the insulation support 7*b* in embodiment 1) as a part formed into a single piece that passes through an opening 17*a* of the flange 17 and extends across the flange 17 as far as the outside of the flange 17. In the illustrated embodiment, the end of the insulation support 19 reaching to the outside of the flange 17 (the lower end in the Figure) is fastened to the outer surface of the flange 17 and sealed airtight, and the operating mechanism 15 is mounted on this end of the flange 17. The gas-insulated switchgear of FIG. 4 embodies a structure attaining a further reduction in the number of parts while retaining the advantages of the switchgear shown as embodiment 1.

Embodiment 3

Figure 5:
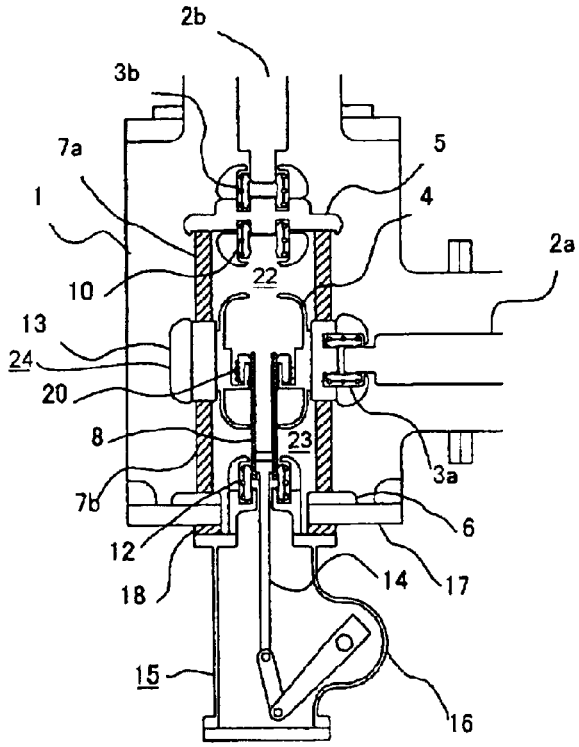
FIG. 5 is a schematic cross-sectional elevation of still another gas-insulated switchgear embodying the present invention.

FIG. 5 illustrates the structure of the disconnector 22 and the grounding switch 23 in a gas-insulated switchgear shown as still another embodiment of the present invention. The gas-insulated switchgear in this embodiment is provided with an electrode 24 that has a single contact (contact 20) in the middle section of the shield 4, different from the gas-insulated switchgear shown as embodiment 1 in FIG. 1 that is provided with the electrode 21 that has two contacts 9 and 11. The movable contact 8 is therefore in contact with the contact 20 in any position in its movement back and forth to cause or break a bridge over a gap between fixed contacts, and the contact 20 of the electrode 24 serves as contact commonly for the disconnector 22 and the grounding switch 23. The gas-insulated switchgear of FIG. 5 embodies a structure attaining a further reduction in the number of parts while retaining the advantages of the switchgears shown as embodiments 1 and Embodiment 4

Figure 6:
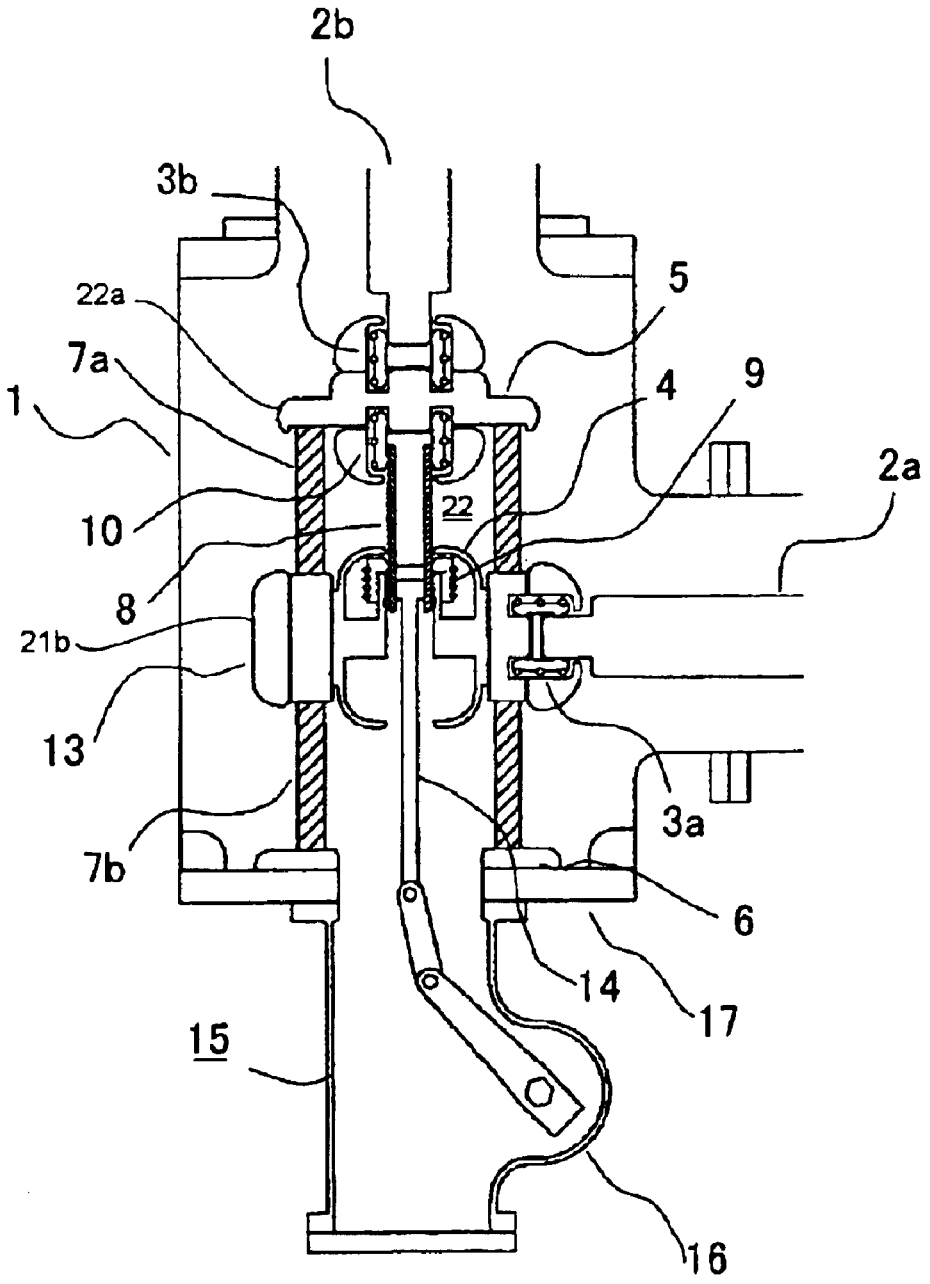
FIG. 6 is a schematic cross-sectional elevation of still another gas-insulated switchgear embodying the present invention.
Figure 7:
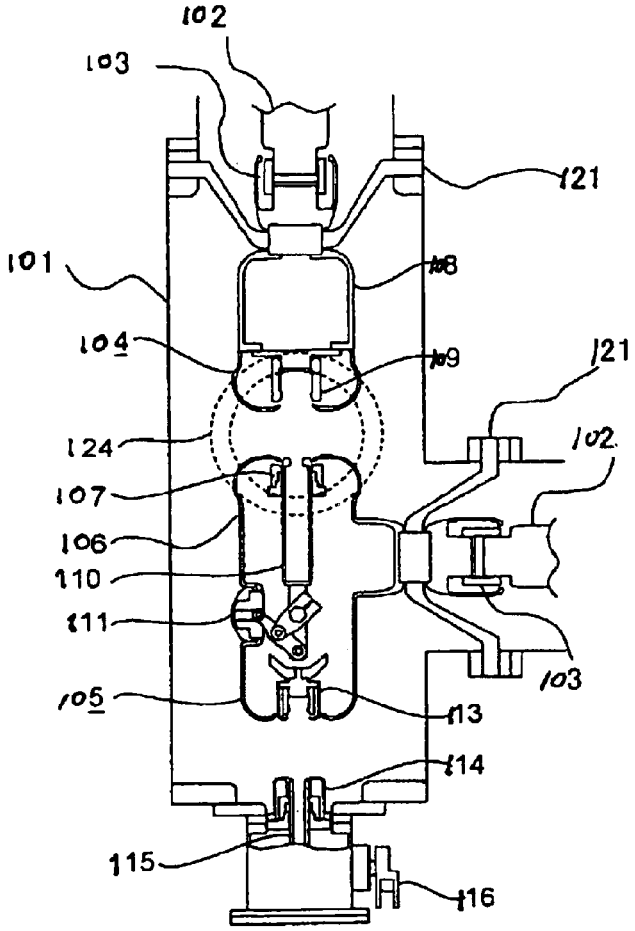
FIG. 7 PRIOR ART
FIG. 7 is a schematic cross-sectional elevation showing an internal structure of a gas-insulated switchgear of the conventional type.
Figure 8:
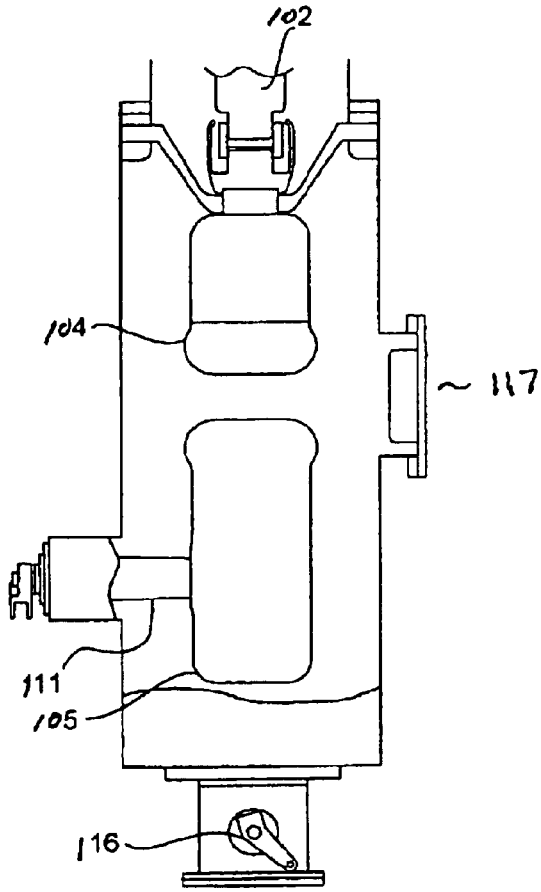
FIG. 8 PRIOR ART
FIG. 8 is a schematic longitudinal cross-sectional elevation of the gas-insulated switchgear shown in FIG. 7.

FIG. 6 illustrates the structure of a gas-insulated switchgear shown as still another embodiment of the present invention. The gas-insulated switchgear in this embodiment 6 differs from the one shown as embodiment 1 in FIG. 1 in that it includes no grounding switch. Thus, the first electrode 21*b* connected to the tip of the first conductor 2*a* of the switchgear in FIG. 6 is provided with only the contact 9 for the disconnector 22. Naturally, the gas-insulated switchgear in this Figure has no contact equivalent to the contact 11 in FIG. 1 and no electrode equivalent to the third electrode 23*a* on the flange 17. Because the movable contact 8 in FIG. 6 is to cause or break a bridge over the gap between the first electrode 21*b* and the second electrode 22*a* only, the strokes given by the operating mechanism 15 are shorter than those given by the equivalent mechanism in FIG. 1.

The disconnector 22, the operating mechanism 15 and other devices around the disconnector and the operating mechanism of the gas-insulated switchgear of FIG. 6 are mounted on the tank 1 through the flange 17 and they are in a size small enough to pass through the open end 1*c* of the tank 1. Thus, like the embodiments described above, this embodiment has such advantages as a high work efficiently as a result of assembling outside the tank 1 and the elimination of the need for performing such works as inter-electrode adjustment and insulation rod connection inside the tank 1 and for manholes for such works and inspection.

What is claimed is:

1. A gas-insulated switchgear comprising:

a tank filled with an electrically insulating gas;

first and second conductors disposed within said tank;

a disconnector for disconnecting said first conductor and said second conductor from each other; and a grounding switch for grounding said first conductor when said disconnector is in an open position; wherein said disconnector includes a first and second fixed electrode disposed on said first and second conductors, respectively, a bridging movable electrode that is always maintained in contact with said first electrode and that is slidably movable for contacting with and separating from said second fixed electrode to connect and disconnect said first and second fixed electrodes, and an operating mechanism for opening and closing operation of said movable electrode;

said grounding switch includes said bridging movable electrode which is in contact with said first contact, and a third fixed grounding electrode disposed within said tank and being capable of contacting with said movable electrode when said movable electrode is separated from said second electrode; and wherein said operating mechanism is provided with an electrically insulating operating rod extending through said first fixed electrode in the direction of movement of said movable electrode.

2. A gas-insulated switchgear as claimed in claim 1, wherein said movable electrode is an elongated member having an axis extending at substantially right angles relative to said first conductor, said first fixed electrode is annular in shape surrounding a circumferential surface of said movable electrode, and the axis of said insulating operating rod is substantially aligned with said axis of said movable electrode.

3. A gas-insulated switchgear as claimed in claim 1, wherein said disconnector and said grounding switch are provided with insulation supports supporting said first and second fixed electrodes and said movable electrode, and are supported only by a flange closing the open end of said tank.

4. A gas-insulated switchgear as claimed in claim 1, wherein the sections of said disconnector and said grounding switch to be accommodated within said tank are in a size smaller than the open end of said tank so that said disconnector and said grounding switch can be altogether introduced into said tank as being assembled on said flange.

5. A gas-insulated switchgear as claimed in claim 1, wherein said first fixed electrode is provided with a disconnector contacting section facing to said second fixed electrode and a grounding switch contacting section facing to said third fixed electrode as separate members.

6. A gas-insulated switchgear as claimed in claim 1, wherein said first fixed electrode is provided with a single contacting section that serves as contacting section commonly for said disconnector wherein said contacting section faces to said second fixed electrode and for said grounding switch wherein said contacting section faces to said third fixed electrode.

7. A gas-insulated switchgear comprising:

a tank filled with an electrically insulating gas;

first and second conductors disposed within said tank; and a disconnector disconnecting said first conductor and said second conductor from each other, wherein said disconnector includes a first and second fixed electrode disposed on said first and second conductors, respectively, a bridging movable electrode for connecting and disconnecting said first and second fixed electrodes from each other, and an operating mechanism for opening and closing operation of said movable electrode;

said movable electrode is always in contact with said first fixed electrode and capable of contacting with and separating from said second fixed electrode; and wherein said operating mechanism is provided with an electrically insulating operating rod extending through said first fixed electrode in the direction of movement of said movable electrode.

8. A gas-insulated switchgear as claimed in claim 7, wherein said movable electrode is an elongated member having an axis extending at substantially right angles relative to said first conductor, said first fixed electrode is annular in shape surrounding a circumferential surface of said movable electrode, and the axis of said insulating operating rod is substantially aligned with said axis of said movable electrode.

9. A gas-insulated switchgear as claimed in claim 7, wherein said disconnector is supported within said tank solely by a flange closing an open end of said tank.

10. A gas-insulated switchgear as claimed in claim 7, wherein the dimension of said disconnector to be accommodated within the tank is smaller than that of an opening of said tank so that said disconnector can be introduced into said tank as being assembled on said flange.

* * * * *